US005880564A

United States Patent [19]

Franck

[11] Patent Number: 5,880,564

[45] Date of Patent: Mar. 9, 1999

[54] HIGH-FREQUENCY OPERATING CIRCUIT FOR A LOW-PRESSURE DISCHARGE LAMP WITH IMPROVED ELECTROMAGNETIC COMPATIBILITY

[75] Inventor: Felix Franck, Munich, Germany

[73] Assignee: Patent-Treuhand-Gesellschaft fuer elektrische Gluehlampen mbH, Munich, Germany

[21] Appl. No.: 853,997

[22] Filed: May 9, 1997

[30] Foreign Application Priority Data

May 15, 1996 [DE] Germany ..... 196 19 581.0

[51] Int. Cl.[6] ..... H05B 41/16

[52] U.S. Cl. ..... 315/247; 315/205; 315/209 R

[58] Field of Search ..... 315/209 R, 205, 315/DIG. 5, 247

[56] References Cited

U.S. PATENT DOCUMENTS 4,808,887 2/1989 Fahnrich et al. ..... 315/247

OTHER PUBLICATIONS

*Elektronik–schaltungen, Hirschmann*, 1982, pp. 134–159.

*Betriebsgerate und Schaltungen fur elektrische Lampen*, Sturm and Klein, 1992, pp. 121–137.

*Primary Examiner*—Arnold Kinkead

*Attorney, Agent, or Firm*—Carlo S. Bessone

[57] ABSTRACT

A circuit is proposed for the high-frequency operation of at least one lamp with an active harmonic filter with at least one capacitive pump branch with a pump capacitor (C1; C2) for feeding the energy back to a filter capacitor (C4) from a connection point on the lamp side between and including a central tap of the push-pull frequency generator and a first lamp diode, is characterized by the fact that a trapezoidal capacitor (CT1; CT2) is provided between a point of at least one pump branch, which, from the central tap of the push-pull frequency generator, lies out behind capacitor (C1; C2) of the pump branch, and one of the external taps, and thus the one or more pump capacitors of the one or more pump branches are the only capacitors connected in a direct capacitive load at the central tap of the push-pull frequency generator and/or no resonance capacitor (C6) connected directly in parallel to the lamp in the operating state is provided for lamp ignition.

8 Claims, 2 Drawing Sheets

HIGH-FREQUENCY OPERATING CIRCUIT FOR A LOW-PRESSURE DISCHARGE LAMP WITH IMPROVED ELECTROMAGNETIC COMPATIBILITY

BACKGROUND OF THE INVENTION

The present invention concerns an operating switch for one or more lamps, particularly low-pressure discharge lamps, which will be operated with a high-frequency power. The high-frequency operation of low-pressure discharge lamps has the advantage of a clear increase in the efficiency of the lamp, in addition to avoiding a mains-frequency radiation of the irradiated light with mains operation. Refer to C. H. Sturm and E. Klein "Operating devices and circuits for electrical lamps", 6th Edition, 1992, Siemens AG, particularly pages 121 to 137, as well as to W. Hirschmann "Electronic circuits", 1982, Siemens AG, pages 147 and 148 for an introduction to basic circuit construction of corresponding ballast devices.

A circuit for high-frequency operation is shown in EP 0 253,224 B1, by which the invention is limited. This circuit of the state of the art has a resonance capacitor for lamp ignition connected directly parallel to the lamp proceeding via the named components, as well as a capacitor connected between the central tap of the push-pull frequency generator and the central tap between the diodes of one of the pump branches (the capacitors are denoted there as C6 or C7). FIG. 1 shows the corresponding circuit structure, whereby the above capacitors are denoted there as C6 or CT2. For a further description of this circuit, refer to the description of the invention given below, for which the example of embodiment shown in FIG. 2 is constructed on the circuit shown in FIG. 1.

Electronic ballast devices for lamps driven with high frequency generally show high-frequency feedback to the mains (with mains operation) or another voltage source as well as a high-frequency electromagnetic irradiation. The sensitivity of other electronic devices and the increasingly dense packing of such devices in the direct operating environment of electronic ballast devices for lamps, however, places increasing requirements for electromagnetic compatibility of an electronic ballast device, which is a potential source of high-frequency interference. Refer to C. H. Sturm and E. Klein (op. cit., p. 122 ff).

SUMMARY OF THE INVENTION

The basis of the invention is the technical problem of further improving the operating properties of the circuit of the state of the art with particular consideration of electromagnetic compatibility.

This problem is resolved by a circuit which is characterized by the fact that a trapezoidal capacitor is provided between one point of at least one pump branch, which lies behind the capacitor of the pump branch out from the center tap of the push-pull frequency generator, and an external tap, and thus the one or more pump capacitors of the one or more pump branches are the only capacitors with directly capacitive loads connected at the central tap of the push-pull frequency generator and/or no resonance capacitor directly connected in parallel to the lamps in the operating state is provided with for lamp ignition.

The formulation "in the operating state" will consider the fact that special preheating or igniting circuits under certain circumstances can lead to a parallel connection of a capacitor during a preheating or igniting phase, without falling outside the scope of the claims. The only circumstance that is decisive for the concept of the invention is that these capacitors are practically disconnected in the operating state.

As described above, a trapezoidal capacitor connected behind the pump capacitor has the advantage that the push-pull frequency generator is loaded capacitively, with a serial connection from the pump capacitor and the trapezoidal capacitor, instead of with a parallel circuit. The larger the capacity is that is directly connected to the central tap of the push-pull frequency generator, the more difficult is the unloading of its transistors from the circuit.

Thus, if simultaneously with the above circuit of the trapezoidal capacitor, the conventional parallelly connected trapezoidal capacitor is omitted, the push-pull frequency generator is only capacitively when overloaded when the capacitors have large capacity values. The advantage consequently lies in the fact that the pump capacitors can be selected with larger values for the sake of the pump power of the pump branch and the trapezoidal capacitor. Since the pump branch of the harmonic filter improves the sinusoidal form of the mains current uptake with mains operation, the first point of electromagnetic compatibility is also favored.

Further, a lamp-parallel capacitive path for lamp ignition can be switched on by the trapezoidal capacitor connected according to the invention by resonance voltage amplitudes, so that the conventional lamp-parallel resonance capacitor can be dispensed with. A clear reduction in the current load of the push-pull frequency generator due to the absence of the high-frequency current through the resonance capacitor previously used results therefrom.

The capacitive coupling of a connection point within the corresponding pump branch with the external tap of the push-pull frequency generator results in eliminating the interference of the pump branch, an advantage that has not previously been provided in the state of the art.

Overall, multiple improvements in operating properties can be obtained when compared with a conventional circuit by moving one or more capacitors behind the one or more pump capacitors.

The term "trapezoidal capacitor" used here has been adopted in this technical field and generally characterizes a relatively small capacitor, which serves for temporary "attenuation" of reloading and intermittent potential processes, which are relatively "hard" without such capacitors, i.e., would run with very steep potential-time edges, but an oblique, trapezoidal-type potential-time form is obtained by means of the trapezoidal capacitor.

The circuit of the invention finds an advantageous and important field of application in high-frequency discharge lamps and particularly in low-pressure discharge lamps.

Usually, electronic ballast devices, which are the basis of the invention, are operated via a mains rectifier on the AC network. Therefore, considerable advantages result from the above when compared with the adverse effect of high frequency on other devices supplied by line transmission from the mains.

According to another configuration, the pump branch has a serial circuit of two diodes between the DC voltage source and an external tap of the push-pull frequency generator, whereby the pass-through direction of the diodes corresponds to the polarity of the DC voltage source. Thus it connects a central tap between the two diodes via the pump capacitor with a point between a resonance inductance connected—as usual—to the central tap of the push-pull frequency generator and the connection of the first lamp electrode. A trapezoidal capacitor is assigned to this pump branch according to the invention, whereby the latter can be connected on the side of the pump branch at the central tap between the diodes.

According to another or additional configuration, one pump branch again has a serial circuit of two diodes between the DC voltage source and an external tap of the push-pull frequency generator with the polarity of the DC voltage source of the corresponding pass-through direction of the diodes, but joins a central tap between the two diodes by means of the pump capacitor directly with the central tap of the push-pull frequency generator. Analogously, a trapezoidal capacitor is assigned to this pump branch according to the invention, whereby the latter can be connected on the side of the pump branch at the central tap between the diodes.

Of course, it is generally valid that a circuit according to the invention can have two or more pump branches, whereby one trapezoidal capacitor is provided for one part or for all of the pump branches.

A typical dimensioning for the capacity of the one or more trapezoidal capacitors can be one-fifth up to one-twentieth, or approximately one-tenth of the capacity of the one or more capacitors in the corresponding pump branches.

BRIEF DESCRIPTION OF THE DRAWINGS

The invention will be explained below in more detail on the basis of an example of embodiment. For better understanding, reference is also made to the state of the art given above.

BEST MODE FOR CARRYING OUT THE INVENTION

Figure 1:
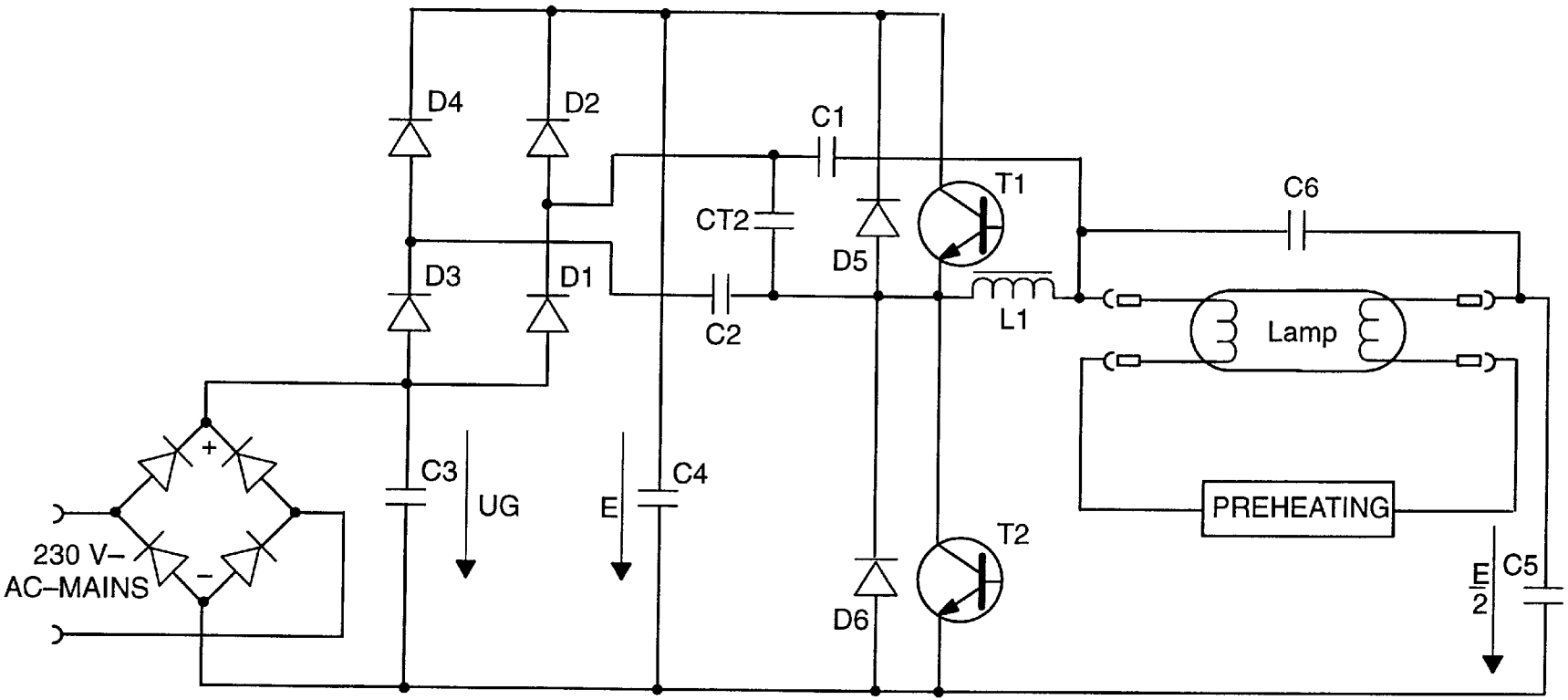
FIG. 1 PRIOR ART
FIG. 1 shows a schematic circuit diagram of a circuit of the prior art.

In both cases, a mains rectifier, represented by the diode bridge, is shown as the DC voltage source. A rectified voltage with a total modulation of 100 Hz is applied to supporting capacitor C3, generally an arbitrary voltage with a DC voltage component.

The rectified voltage is conducted to a half-bridge comprised of two bipolar transistors T1 and T2 by means of diodes D1 through D4 belonging to a harmonic filter, which will be described in more detail below, and by means of filter capacitor C4 which is connected between the plus line lying at the top of the figure and the minus line lying at the bottom. Together with a control transformer (not shown) for controlling the bases of T1 and T2, a push-pull frequency generator is formed in this way, which, properly speaking, shifts the potential of the central tap between the transistors alternatively to the potential of the plus line and that of the minus line. For reasons of clarity, the unessential components of the circuit have been omitted in the figures for the principle of the invention, including the control transformer, the starting circuit, which will be mentioned further below, the external resistances, etc.

The control transformer is described in the above-mentioned publications, particularly in C. H. Sturm and E. Klein and in W. Hirschmann, and essentially comprises a primary winding in series with a resonance inductance L1 connected at the central tap between transistors T1 and T2 and two secondary windings wound in a direction opposite to each other in the control circuits to the bases of the transistors. The saturation inductance is designed in such a way that short switching pauses result between the line periods of the two transistors T1 and T2.

The starting circuit essentially comprises a capacitor, which, in the case of the pass-through voltage of a DIAC, is discharged through the latter into one of the transistor bases an is also described in the cited publications.

The transistors are each provided with free-running diodes parallel to the break for clearing the space charges in the transistors in the off-state.

A serial circuit from the resonance inductance L1, a low-pressure discharge lamp, i.e., its discharging segment, and a coupling capacitor C5 for separating the DC current are connected between the central tap and the lower (i.e., minus) external tap of the push-pull frequency generator.

A parallel circuit of two serial circuits, each one of two diodes D1 and D2 or D3 and D4 is connected between the plus connection of supporting capacitor C3 and the plus connection of filter capacitor C4, whereby the diode pass-through direction each time corresponds to the DC direction from the mains rectifier. A pump capacitor C1 is connected between a central tap of the diode serial circuit of D1 and D2, on the one hand, and a connection point between resonance inductance L1 and the corresponding terminal of the lamp, on the other hand, whereby a first pump branch of a harmonic filter is formed. Correspondingly, a second pump branch is formed from diodes D3 and D4 and pump capacitor C2 connected between its central tap and the central tap of the push-pull frequency generator.

The pump branch D1, D2, C1 taps off a high-frequency potential between L1 and the lamp, carries out a conversion into a pump current by means of capacitor C1 and supplies the voltage $U_G$ for voltage E with this current rectified by diodes D1 and D2. Correspondingly, the other pump branch D3, D4, C2 operates with the use of the potential at the central tap of the transistor bridge.

The task of this harmonic filter with branches D1, D2, C1 and D3, D4, C2 is to produce a voltage E that is smoothed as much as possible when compared with voltage $U_G$ on supporting capacitor C3 by feeding energy back to filter capacitor C4, and thus to assure, as much as possible, a sinusoidal mains current uptake of the mains rectifier. The electromagnetic compatibility will be optimized not only relative to the feedback into the DC voltage source, thus here into the mains via the rectifier connection, but also with respect to electromagnetic radiation. For other details refer to the cited literature, particularly to EP 0 253,224 B1.

In the circuit described in this state of the art, a capacitor, which represents an additional capacitive load of transistor bridges T1–T2, designated as C7 in the given document and as CT2 in FIG. 1 here, lies between the central tap of the push-pull frequency generator and the central tap between diodes D1 and D2. This would apply also to a conventional trapezoidal capacitor of transistor T1 parallel to diode D5 or any corresponding capacitive coupling, which taps at the central tap of the push-pull frequency generator.

Figure 2:
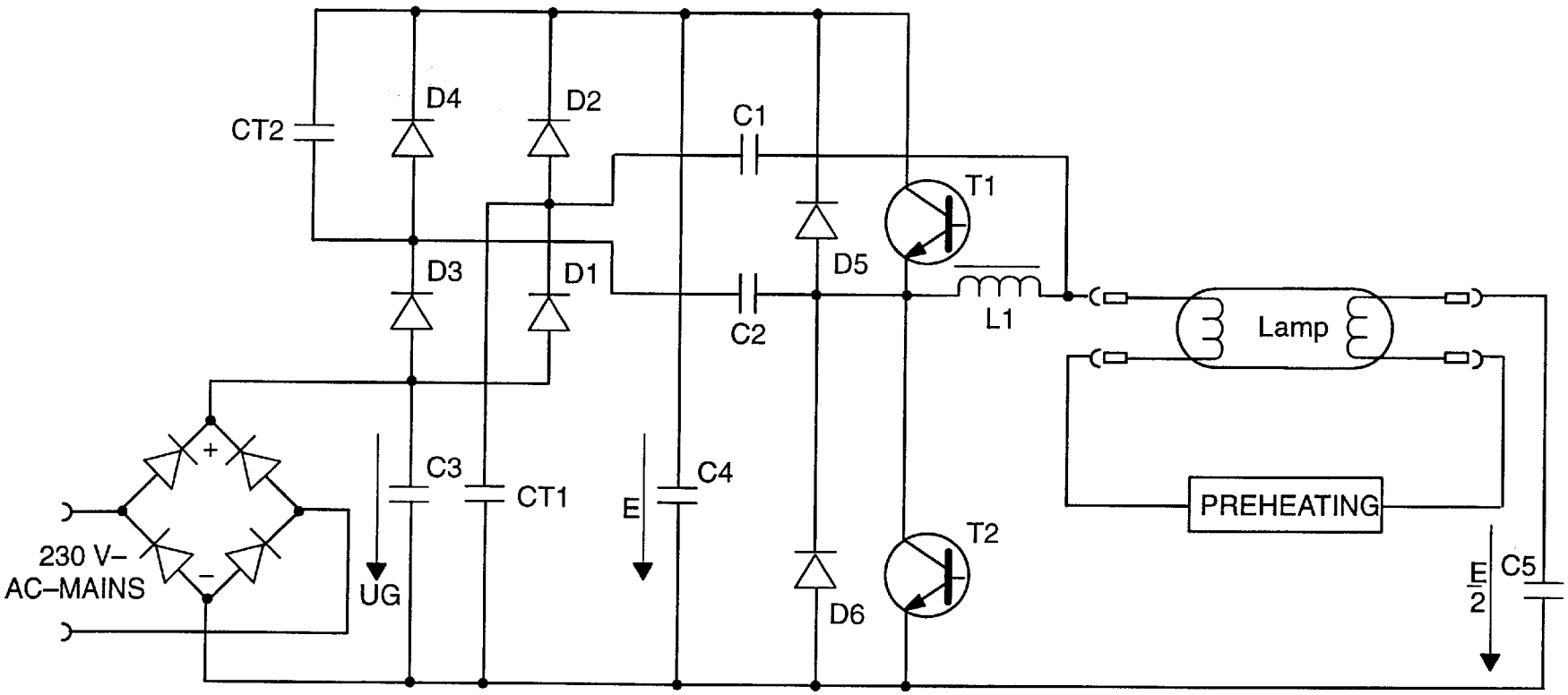
FIG. 2 shows a circuit diagram of a circuit for high-frequency operation of at least one lamp according to the present invention.

According to the invention, the lower terminal of capacitor CT2 is shifted, so to speak, and in fact lies behind pump capacitor C2, so that the capacitor in FIG. 2 lies on one side between the central tap between D3 and D4 and on the other side the upper plus line, thus, the upper external tap of the push-pull frequency generator. It thus forms a trapezoidal capacitor in series with C2 for the push-pull frequency generator and over and above this, a trapezoidal capacitor for pump branch D3, D4, C2.

The resonance capacitor, which is parallel to the lamp and is provided also in the named state of the art and designated there and in FIG. 1 as C6, is shifted according to the invention in the same way behind a pump capacitor, and in fact behind the capacitor of the other pump branch, C1. It is shown there in FIG. 2 and designated CT1.

More precisely, it lies between the central tap between D1 and D2 on one side, and the lower minus line, thus the lower external tap of the push-pull frequency generator on the other side. It thus switches on a lamp-parallel capacitive segment from L1 out over C1, CT1, and C5 for the resonance ignition of the lamp. Further, it serves as the trapezoidal capacitor for pump branch D1, D2, C1. It is also immediately obvious that by the shift according to the invention, the current load of the push-pull frequency generator is reduced at the terminal of resonance inductance L1 on the lamp side by the high-frequency current through C6 (from FIG. 1).

If one conceivably omits the lamp-parallel resonance capacitor C6 in the circuit in FIG. 1, there further results a circuit comprised of L1, C1, CT2 and C2 joined only by diodes, transistors and the lamp with the "frame" of the circuit defined in potential finally by the network. In this way, there results for short times, in which none of the semiconductor components are conductive, a "free floating" (almost ground-free) state of this circuit segment, which leads to sharp potential discontinuities, if the circuit segment is again captured, so to speak (so-called "chatter"). Relative to this, capacitors CT1 and CT2 in FIG. 2 operate, and in fact one of the two is already active, and these capacitors act as trapezoidal capacitors and they thus improve the electromagnetic compatibility of the entire circuit.

A typical dimensioning of the indicated example of embodiment is as follows: C4 lies at several microfarads; C3 is smaller by a factor of 20 to 30; C5 is again smaller than C3 by a factor of 5 to 10; C1 and C2 are smaller than C3 by a factor 30 to 70, and thus amount to several nanofarads; CT1 and CT2 again are smaller than C1 or C2 by a factor of 10; the inductance L1 depends on the lamp and amounts to several microhenrys. Thus, e.g.:

C1=7.5 nF

C2=3.3 nF

C3=220 nF

C4=6.8 nF

C5=30 nF

CT1=CT2=680 pF

L1=3.0 $\mu$H

What is claimed is:

1. A circuit for high-frequency operation of at least one lamp with:

a DC voltage source, a push-pull frequency generator with a central tap for a first lamp electrode, which is connected to the DC voltage source, and is provided with two external taps, one of which is used for the other lamp electrode;

a filter capacitor (C4) between the external taps of the push-pull frequency generator, and an active harmonic filter with at least one capacitive pump branch with a pump capacitor (C1; C2) for feeding the energy back to filter capacitor (C4) from a connection point on the lamp side including between the central tap of the push-pull frequency generator and the first lamp electrode, is hereby characterized in that a trapezoidal capacitor (CT1; CT2) is provided between a point of at least one pump branch, which, from the central tap of the push-pull frequency generator, lies out behind capacitor (C1; C2) of the pump branch and one of the external taps, and the one or more pump capacitors (C1; C2) of the one or more pump branches are the only capacitors connected directly in a capacitive load at the central tap of the push-pull frequency generator.

2. The circuit according to claim 1 in which the lamp is a low-pressure discharge lamp.

3. The circuit according to claim 1, in which the DC voltage source is a mains rectifier and a supporting capacitor (C3).

4. The circuit according to claim 1, in which the pump branch has a serial circuit of two diodes (D1, D2; D3, D4) between the DC voltage source and an external tap of the push-pull frequency generator, whereby the pass-through direction of the diodes corresponds to the polarity of the DC voltage source, and joins a central tap between the two diodes via capacitor (C1) with a point between a resonance inductance (L1) connected to the central tap of the push-pull frequency generator and the terminal of the first lamp electrode, and a trapezoidal capacitor (CT1) is assigned to this pump branch.

5. The circuit according to claim 1, in which the pump branch has a serial circuit of two diodes (D1, D2; D3, D4) between the DC voltage source and an external tap of the push-pull frequency generator, whereby the pass-through direction of the diodes corresponds to the polarity of the DC voltage source, and joins a central tap between the two diodes via capacitor (C2) with the central tap of the push-pull frequency generator, and a trapezoidal capacitor (CT2) is assigned to this pump branch.

6. The circuit according to claim 1, in which a trapezoidal capacitor (CT1, CT2) is assigned to each pump branch.

7. The circuit according to claim 1, in which the one or more trapezoidal capacitors (CT1; CT2) are connected between the central tap between the respective two diodes (D1, D2; D3, D4) and one of the external taps.

8. The circuit according to claim 1, in which the one or more trapezoidal capacitors (CT1; CT2) each has or have approximately one-tenth the capacity of the one or more respective capacitors (C1; C2) in the corresponding pump branches.

* * * * *